US009347460B2

(12) United States Patent
Yagi et al.

(10) Patent No.: US 9,347,460 B2
(45) Date of Patent: May 24, 2016

(54) ROTARY MACHINE

(75) Inventors: Nobuyori Yagi, Tokyo (JP); Akihiro Nakaniwa, Tokyo (JP); Hitoshi Shinohara, Hiroshima (JP)

(73) Assignees: MITSUBISHI HEAVY INDUSTRIES, LTD., Tokyo (JP); MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 446 days.

(21) Appl. No.: 13/990,483

(22) PCT Filed: Oct. 25, 2011

(86) PCT No.: PCT/JP2011/074555

§ 371 (c)(1),
(2), (4) Date: May 30, 2013

(87) PCT Pub. No.: WO2012/077422

PCT Pub. Date: Jun. 14, 2012

(65) Prior Publication Data

US 2013/0251531 A1 Sep. 26, 2013

(30) Foreign Application Priority Data

Dec. 8, 2010 (JP) ..... 2010-273589

(51) Int. Cl.
*F04D 29/28* (2006.01)
*F04D 29/20* (2006.01)
(Continued)

(52) U.S. Cl.
CPC ..... *F04D 29/20* (2013.01); *F04D 17/10* (2013.01); *F04D 17/12* (2013.01); *F04D 29/2222* (2013.01); *F04D 29/266* (2013.01); *F04D 29/30* (2013.01)

(58) Field of Classification Search
CPC . F04D 29/20; F04D 29/2211; F04D 29/2216; F04D 29/2222; F04D 29/266; F04D 29/286; F04D 17/12
See application file for complete search history.

(56) References Cited

U.S. PATENT DOCUMENTS 2,526,751 A 10/1950 Hornschuch
3,019,039 A * 1/1962 Clavell ..... F01D 5/025 403/273

(Continued)

FOREIGN PATENT DOCUMENTS

CN 1975173 6/2007
CN 101523056 9/2009

(Continued)

OTHER PUBLICATIONS

International Search Report issued Jan. 24, 2012 in International (PCT) Application No. PCT/JP2011/074555 with English translation.

(Continued)

*Primary Examiner* — Ninh H Nguyen
(74) *Attorney, Agent, or Firm* — Wenderoth, Lind & Ponack, L.L.P.

(57) ABSTRACT

A rotary machine includes: a shaft that rotates; a disc that has a substantially cylindrical hub fitted into the shaft and is provided so as to widen outward in a radial direction from a front end to a rear end of the substantially cylindrical hub; and an impeller having a plurality of blades provided on a surface of the disc. The substantially cylindrical hub has a tight fit section having an internal radius that is smaller than a radius of the shaft, and a loose fit section having an internal radius that is greater than the internal radius of the tight fit section. The loose fit section is provided on a front end side of the substantially cylindrical hub with respect to the tight fit section.

8 Claims, 6 Drawing Sheets

(51) Int. Cl.

| | |
|---|---|
| ***F04D 29/26*** | (2006.01) |
| ***F04D 29/30*** | (2006.01) |
| ***F04D 17/12*** | (2006.01) |
| ***F04D 17/10*** | (2006.01) |
| ***F04D 29/22*** | (2006.01) |

(56) References Cited

U.S. PATENT DOCUMENTS

| | | | | |
|---|---|---|---|---|
| 3,715,176 | A * | 2/1973 | Kerklo | F01D 5/043 415/199.1 |
| 3,884,595 | A | 5/1975 | Herrick | |
| 4,053,261 | A | 10/1977 | Pennig | |
| 4,183,719 | A | 1/1980 | Bozung | |
| 4,375,926 | A * | 3/1983 | Feller | F16D 1/092 403/15 |
| 4,548,547 | A | 10/1985 | Deuring | |
| 4,697,987 | A | 10/1987 | Katayama et al. | |
| 7,632,073 | B2 | 12/2009 | Ranz et al. | |
| 7,748,960 | B1 * | 7/2010 | Marussich | F04D 29/266 415/216.1 |
| 2007/0128044 | A1 | 6/2007 | Kawai et al. | |

FOREIGN PATENT DOCUMENTS

| | | |
|---|---|---|
| DE | 24 57 231 | 4/1976 |
| DE | 26 21 201 | 11/1977 |
| DE | 41 41 427 | 6/1993 |
| DE | 197 36 333 | 3/1999 |
| DE | 101 01 165 | 7/2002 |
| JP | 62-703 | 1/1987 |
| JP | 62-271996 | 11/1987 |
| JP | 63-26701 | 2/1988 |
| JP | 5-38393 | 5/1993 |
| JP | 7-211962 | 8/1995 |
| JP | 2003-293988 | 10/2003 |
| JP | 2007-154678 | 6/2007 |
| JP | 2009-228774 | 10/2009 |
| WO | 2011/003409 | 1/2011 |

OTHER PUBLICATIONS

Written Opinion of the International Searching Authority issued Jan. 24, 2012 in International (PCT) Application No. PCT/JP2011/074555 with English translation.

European Third Party Observation issued Jul. 28, 2014 in corresponding European Patent Application No. 11846289.4 with English translation.

Chinese Office Action issued Apr. 29, 2015 in corresponding Chinese Patent Application No. 201180058541.4 with English translation.

Extended European Search Report issued Jun. 11, 2015 in corresponding European Patent Application No. 15153938.4.

Extended European Search Report issued Jun. 11, 2015 in corresponding European Patent Application No. 15153937.6.

Extended European Search Report issued Jun. 15, 2015 in corresponding European Patent Application No. 15153939.2.

* cited by examiner

ROTARY MACHINE

TECHNICAL FIELD

The present invention relates to a rotary machine with which an impeller is equipped.

This application claims priority to and the benefit of Japanese Patent Application No. 2010-273589 filed on Dec. 8, 2010, the disclosure of which is incorporated herein by reference.

BACKGROUND ART

A centrifugal compressor used for a rotary machine such as an industrial compressor, a turbo refrigerator, and a small gas turbine includes an impeller provided with a plurality of blades on a disc fixed to a shaft. The centrifugal compressor gives pressure energy and speed energy to a gas by rotating the impeller.

FIG. 6 is an explanatory view of a rotary machine of the related art that includes an impeller 201.

For example, a rotary machine of PTL 1 includes the impeller 201 constituted by a disc 203, a blade 204, and a cover 206. At a predetermined position of the impeller 201 in an axial direction, a sleeve portion 205 is formed integrally with the impeller 201. By performing shrinkage-fitting of the sleeve portion 205 to the shaft 202 at the predetermined position, the impeller 201 is fixed to the shaft 202.

PTL 1 discloses that when an internal radius of the sleeve portion 205 is set to R and a thickness in the range of the length L is set to T, the length L in which the centrifugal force of the impeller 201 does not affect the sleeve portion 205 is expressed by the following expression (1).

[Expression 1]

$$L \geq 1.8\sqrt{RT} \quad (1)$$

That is, PTL 1 discloses that the influence of the radial displacement of the inner diameter of the impeller 201 due to the centrifugal force during rotation to the sleeve portion 205 is suppressed by setting the length L so as to satisfy the expression (1), and the stable operation is maintained without deviation of the impeller 201 and the shaft 202.

CITATION LIST

Patent Literature

[PTL 1] U.S. Pat. No. 4,697,987

Technical Problem

In general, the cover 206, the blade 204, and the disc 203 are molded as individual components, and then the blade 204 and the cover 206 are mounted on the disc 203 by welding or the like.

In the case of the impeller 201 of PTL 1, the sleeve portion 205 is placed at a position separated from an inner circumferential portion B of the disc 203 by a length L so as to satisfy the expression (1). That is, the sleeve portion 205 is placed so as to project to the side of the disc 203 in the axial direction on which the blade 204 and the cover 206 are mounted.

For this reason, when the blade 204 and the cover 206 are mounted on the disc 203 by welding or the like, there is a problem in that the sleeve portion 205 projecting from the disc 203 is obstructive, and workability is degraded.

Furthermore, the centrifugal compressor used for the rotary machine of recent years requires an improvement in performance such as a high output and a high rotation.

In general, the center of a half section of the impeller 201 of PTL 1 is placed on the disc 203 side that is provided with the blade 204, the cover 206 or the like. That is, the center of the half section of the impeller 201 is placed at the position that is greatly separated from the sleeve portion 205.

According to PTL 1, by placing the sleeve portion 205 so as to be separated by the length L, it is possible to suppress the radial displacement of the impeller 201 due to the centrifugal force affecting the sleeve portion 205.

However, since the center of the half section of the impeller 201 is greatly separated from the sleeve portion 205, the sleeve portion 205 easily extends outward in the radial direction due to the centrifugal force of the impeller 201. Particularly, as output and rotation of the impeller 201 become higher, there is a concern that the influence of the radial displacement of the impeller 201 may not be suppressible. Thus, there is a risk of the sleeve portion 205 widening, deviation occurring between the impeller 201 and the shaft 202, and the performance of the rotary machine deteriorating.

SUMMARY OF INVENTION

Thus, the present invention is made in view of the above-mentioned circumstances, and an object thereof is to provide a rotary machine that has satisfactory workability during manufacturing, and is capable of suppressing the deviation between the impeller and the shaft at the time of rotation.

Solution to Problem

In order to achieve the above-mentioned object, according to the present invention, there is provided a rotary machine that includes a shaft that rotates; a disc that has a substantially cylindrical hub fitted into the shaft and is provided so as to widen outward in a radial direction from a front end to a rear end of the hub; and an impeller having a plurality of blades provided on a surface of the disc, wherein the hub has a tight fit section having an internal radius smaller than a radius of the shaft, and a loose fit section having an internal radius greater than the internal radius of the tight fit section, and the loose fit section is provided on the front end side of the hub with respect to the tight fit section.

According to the present invention, the blade is provided on the surface of the disc, and the hub is provided without projecting from the surface of the disc. For this reason, when the blade is mounted on the surface of the disc, the hub is not obstructive. Thus, it is possible to provide the rotary machine having satisfactory workability at the time of manufacturing.

Furthermore, in PTL 1, since the sleeve portion fitted into the shaft is placed so as to be separated from the center of the half section of the impeller, a structure in which the sleeve easily widens outward in the radial direction is provided. However, according to the present invention, the hub is provided so that a part thereof projects from the rear surface of the disc, and the tight fit section having the great tightening allowance is provided on the rear end side of the hub. That is, the hub is provided near the center of the half section of the impeller, and the tight fit section provided in the hub is fixedly fitted into the shaft. Thus, it is possible to prevent the tight fit section from widening due to the centrifugal force at the time of rotation, and the deviation between the impeller and the shaft can be suppressed.

In the rotary machine of the present invention, a groove portion dented so as to surround the hub may be provided on the rear surface of the surface of the disc.

In this case, by providing the groove portion around the hub on the rear surface of the disc, it is possible to suppress the tight fit section from widening outward in the radial direction due to the centrifugal force at the time of rotation, and the contact pressure of the tight fit section can be maintained. Thus, it is possible to reliably suppress the deviation between the impeller and the shaft at the time of rotation.

In addition, the thick portion of the disc can be removed by providing the groove portion, and the thickness difference of each portion of the disc can be reduced. Thus, for example, when enhancing the strength of the disc by quenching, annealing or the like, the entire disc can be evenly heat-treated. Thus, it is possible to provide the rotary machine of high performance having excellent strength.

In the rotary machine of the present invention, a first tapered portion having an external radius gradually increasing toward the front end of the hub may be provided in the rear end of the hub.

For example, in some cases, shortening of the length of the tight fit section may be required due to the circumstances such as the layout of the impeller. In this case, in order to supplement the reduction of the contact pressure due to shortening of the tight fit section, there is a need to increase the thickness of the tight fit section. However, when the thickness of the tight fit section is increased, there is a risk of the thick portion being pulled outward in the radial direction due to the centrifugal force, the tight fit section widening outward in the radial direction, and deviation occurring between the impeller and the shaft.

However, according to the present invention, it is possible to suppress the tight fit section from widening outward in the radial direction due to the centrifugal force, by providing the first tapered portion in the rear end of the hub. Thus, by providing the first tapered portion, it is possible to shorten the length of the tight fit section, while reliably suppressing the deviation between the impeller and the shaft at the time of rotation, and provide a small impeller.

In the rotary machine of the present invention, a sleeve, which is fitted into the shaft so as to come into contact with the front end of the hub and guides the air flow to the disc, may be further included.

In this case, the air flow can be effectively guided by placing the sleeve. In addition, by individually providing the disc and the sleeve, after mounting a blade or the like on the surface of the disc, the sleeve can be placed on the front end of the hub. Thus, when the blade or the like is mounted on the surface of the disc, the sleeve is not obstructive. Thus, it is possible to provide the rotary machine that has satisfactory workability at the time of manufacturing.

In the rotary machine of the present invention, the plurality of impellers may be provided in series in the shaft, a sleeve that guides the air flow to the disc of the other impeller may be further included between the hub of one impeller and another hub of another impeller adjacent thereto, and a second tapered portion having an internal radius gradually decreasing toward the rear end of the sleeve so as to be matched with a shape of the first tapered portion provided in the rear end of the hub may be provided in the front end of the sleeve.

In this case, since the second tapered portion matched with the shape of the first tapered portion is provided in the front end of the sleeve, the sleeve can be placed in the state in which the second tapered portion is brought into contact with the first tapered portion. Thereby, since the second tapered portion is able to press the first tapered portion from the outside in the radial direction, it is possible to suppress the tight fit section from widening outward in the radial direction due to the centrifugal force. Thus, it is possible to reliably suppress deviation between the impeller and the shaft at the time of rotation.

In the rotary machine of the present invention, a concave portion may be provided in any one of the rear end of the sleeve and the front end of the hub, and a convex portion matched with the shape of the concave portion may be provided in the other thereof.

In this case, since it is possible to perform the concave and convex fitting of the rear end of the sleeve and the loose fit section, the movement of the loose fit section can be restricted by the sleeve, and it is possible to suppress the loose fit section from widening outward in the radial direction due to the centrifugal force. Thus, it is possible to reliably suppress the deviation between the impeller and the shaft at the time of rotation.

In the rotary machine of the present invention, a third tapered portion having an internal radius gradually decreasing toward the front end of the sleeve may be provided in the rear end of the sleeve, and a fourth tapered portion having an external radius gradually decreasing toward the front end of the hub so as to be matched with the shape of the third tapered portion may be provided in the front end of the hub.

In this case, the third tapered portion is provided in the rear end of the sleeve. In addition, the fourth tapered portion having the shape matched with the shape of the third tapered portion is provided in the front end of the hub. For this reason, the sleeve can be placed in the state in which the third tapered portion is brought into contact with the fourth tapered portion. Thereby, since the third tapered portion is able to press the fourth tapered portion from the outside in the radial direction, it is possible to suppress the loose fit section from widening outward in the radial direction due to the centrifugal force. Thus, it is possible to reliably suppress the deviation between the impeller and the shaft at the time of rotation.

In the rotary machine of the present invention, the tight fit section may be provided over the front end side with respect to the rear surface of the disc from the rear end of the hub.

In this case, by providing the tight fit section over the front end side with respect to the rear surface of the disc, it is possible to provide the tight fit section at the position that is closer to the center of the half section of the impeller. Thus, it is possible to suppress the deviation between the impeller and the shaft at the time of rotation.

In the rotary machine of the present invention, the hub may further have an intermediate section that connects the tight fit section with the loose fit section.

According to the present invention, by placing the intermediate section between the tight fit section and the loose fit section, the tight fit section is fitted into the shaft at the position separated from the rear surface of the disc to the rear end side of the hub. Thereby, even when the disc widens outward in the radial direction due to the centrifugal force, the intermediate section bends, and the influence on the tight fit section can be relaxed. Thus, since it is possible to suppress the tight fit section from widening outward in the radial direction due to the centrifugal force, it is possible to suppress the deviation between the impeller and the shaft at the time of rotation.

Advantageous Effects of Invention

According to the rotary machine of the present invention, when the blade is mounted on the surface of the disc, the hub is not obstructive, and workability is satisfactory at the time of manufacturing.

Furthermore, according to the rotary machine of the present invention, the tight fit section provided in the hub of the impeller is fixedly fitted into the shaft, it is possible to prevent the tight fit section from widening due to the centrifugal force at the time of the rotation, and it is possible to reliably suppress the deviation between the impeller and the shaft at the time of rotation.

DESCRIPTION OF EMBODIMENTS

Hereinafter, embodiments of the present invention will be described with reference to the drawings.

(Centrifugal Compressor)

Figure 1:
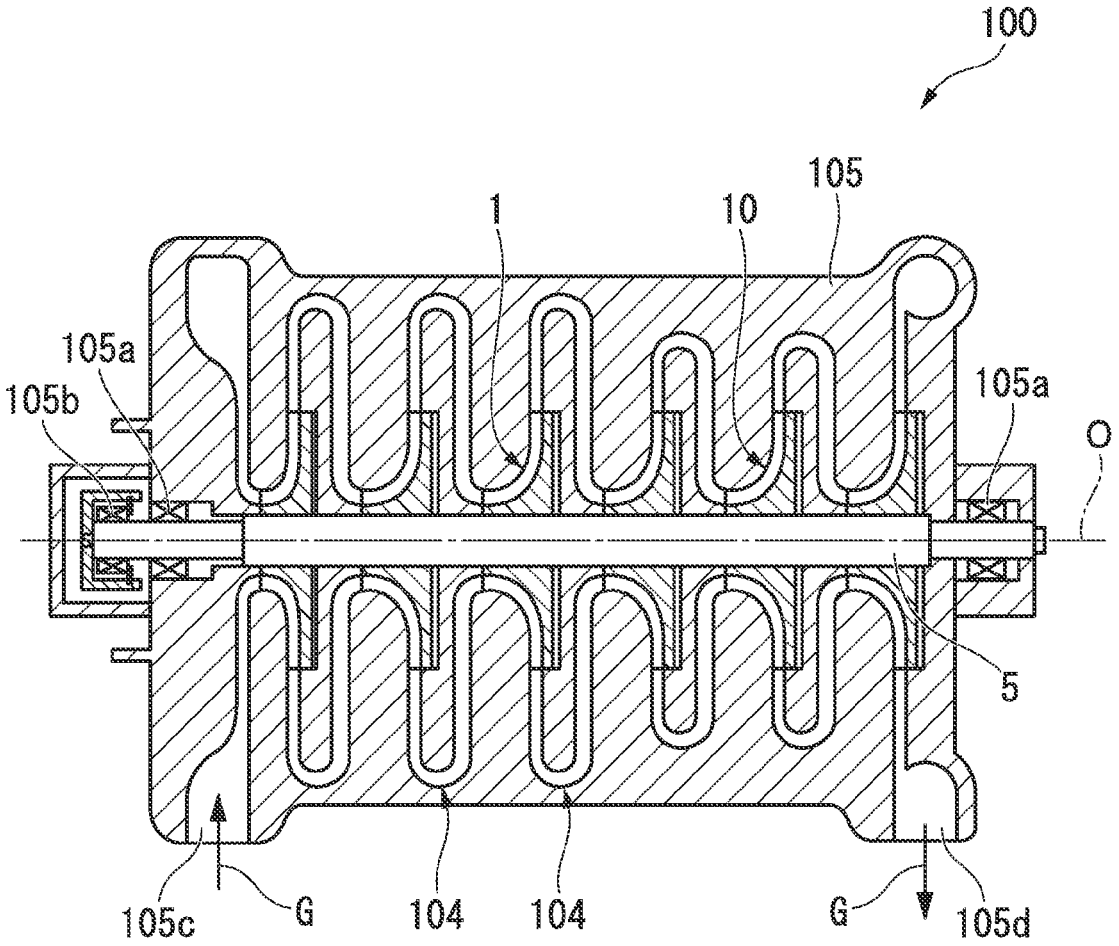
FIG. 1 is an explanatory view of a centrifugal compressor to which a rotary machine of the present invention is applied.

FIG. 1 is an explanatory view of a centrifugal compressor 100 to which a rotary machine 1 of the present invention is applied.

The centrifugal compressor 100 mainly includes a shaft 5 rotating around an axis O, an impeller 10 that is attached to the shaft 5 and compresses a gas G using the centrifugal force, and a casing 105 that rotatably supports the shaft 5 and forms a flow path 104 causing the gas G to flow from an upstream to a downstream. In addition, in the illustrated example, although six impellers 10 are provided in series in the shaft 5, at least one impeller 10 may be provided in the shaft 5.

An outer appearance of the casing 105 is formed in an approximately columnar shape, and the shaft 5 is placed so as to penetrate through the center thereof. On both ends of the shaft 5 in the axial direction, a journal bearing 105*a* is provided. Furthermore, a thrust bearing 105*b* is provided in one end of the shaft 5. The shaft 5 is rotatably supported by the journal bearing 105*a* and the thrust bearing 105*b*. Thereby, the shaft 5 is supported by the casing 105 via the journal bearing 105*a* and the thrust bearing 105*b*.

On one side (a left side in FIG. 1) of the casing 105 in the axial direction, an inlet port 105*c* which causes the gas G to flow in from the outside is provided. Furthermore, on the other side (a right side in FIG. 1) in the axial direction, an outlet port 105*d* through which the gas G flows to the outside is provided.

In the casing 105, an internal space that communicates with the inlet port 105*c* and the outlet port 105*d* and repeats the diameter reduction and the diameter expansion is provided. The internal space is used as a space that accommodates the impeller 10, and also serves as the flow path 104. That is, the inlet port 105*c* and the outlet port 105*d* communicate with each other via the impeller 10 and the flow path 104.

(Rotary Machine of First Embodiment)

Next, the rotary machine 1 of the first embodiment will be described.

Figure 2:
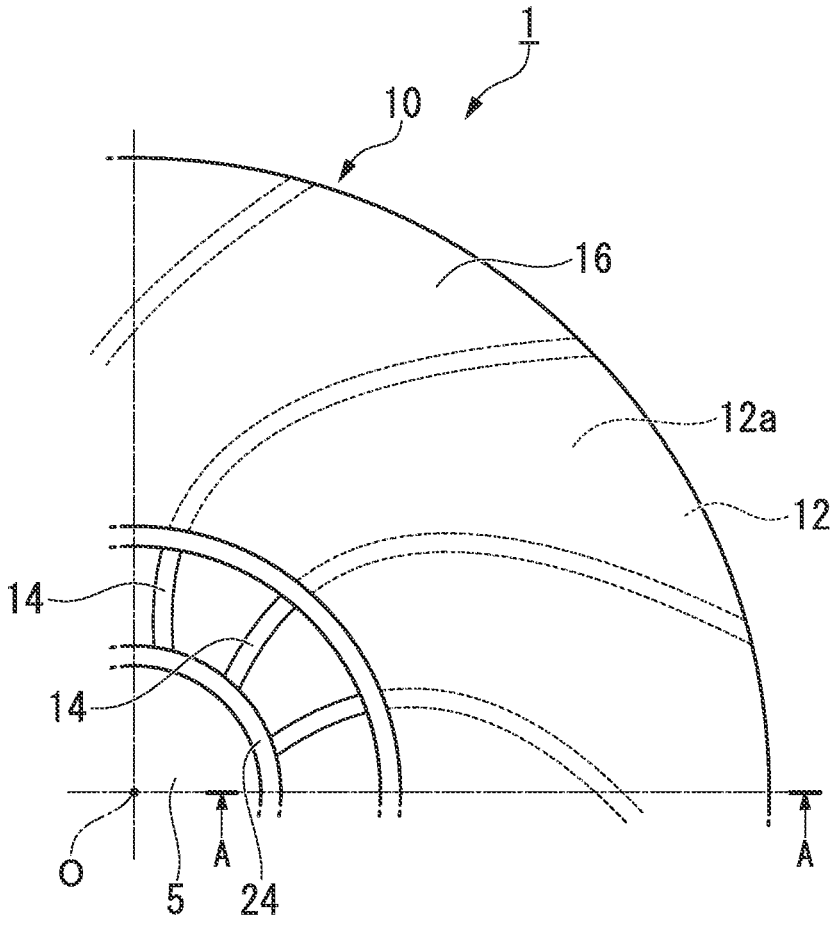
FIG. 2 is an explanatory view of the rotary machine when viewed from an axial direction.

FIG. 2 is an explanatory view of the rotary machine 1 of the first embodiment when viewed from an axial direction.

Figure 3:
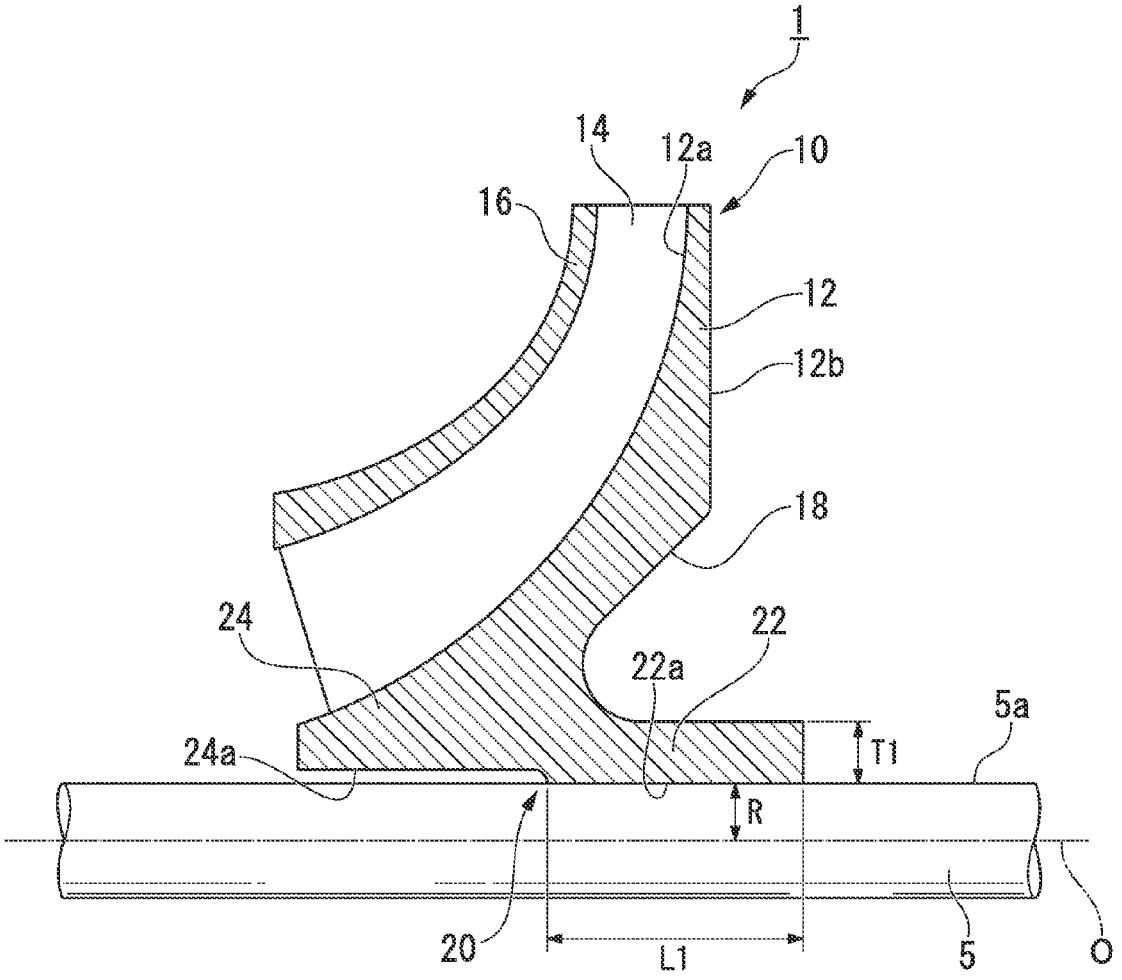
FIG. 3 is a cross-sectional view taken along line A-A of FIG. 2 and an explanatory view of the rotary machine of a first embodiment.

FIG. 3 is a cross-sectional view taken along line A-A of FIG. 2, and an explanatory view of the rotary machine 1 of the first embodiment.

In addition, in the following description, in order to simplify the description, in some cases, the upstream side (corresponding to "front end side" of the claims, and the left side in FIG. 2) of the gas G flowing through the centrifugal compressor 100 is simply referred to as a front side, and the downstream side (corresponding to "rear end side" of the claims, the right side in FIG. 2) is simply referred to as a rear side. Furthermore, in order to simplify the description, a case in which the shaft 5 is provided with one impeller 10 will be described.

(Disc)

The rotary machine 1 illustrated in FIG. 2 includes an impeller 10. The impeller 10 has a disc 12, a plurality of blades 14 provided in the disc 12, and a cover 16 placed so as to be separated from the disc 12 by a predetermined distance.

For example, the disc 12 is formed by precipitation hardening stainless steel, and is a disk-like member having an approximately circular shape when viewed from the axial direction.

The disc 12 has an external diameter that gradually widens from the front side toward the rear side (from the left side to the right side in FIG. 2). A front side surface 12*a* (surface) of the disc 12 is formed in a curved state when viewed from the cross section in the radial direction. The front side surface 12*a* formed in the curved state is configured so that a surface located inside in the radial direction is formed along the axis O and formed so as to gradually follow the radial direction as it moves outward in the radial direction. Moreover, a blade 14 to be described later is attached to the front side surface 12*a* of the disc 12.

Furthermore, the rear side surface 12*b* (rear surface) of the disc 12 is flatly formed. In addition, as will be described later, a groove portion 18 is provided on the rear side surface 12*b* of the disc 12.

A hub 20 fitted into the shaft 5 is provided inside the disc 12 in the radial direction. That is, the disc 12 has the substantially cylindrical hub 20 fitted into the shaft 5. The disc 12 is fitted into the shaft 5 so as to widen outward in the radial direction from the front end of the hub 20 toward the rear end thereof. A part of the hub 20 protrudes from the rear side surface 12*b* of the disc 12. The hub 20 has a through hole that penetrates through the front side and the rear side of the disc 12. The hub 20 has a tight fit section 22 and a loose fit section 24.

The tight fit section 22 has a thickness T1 in the radial direction, and a length L1 from the rear side to the front side (from the right side to the left side in FIG. 2). In addition, the tight fit section 22 is provided over the front side from the rear side surface 12*b* of the disc 12.

An internal radius R of the tight fit section 22 is set to be smaller than the radius of the shaft 5. Moreover, for example, the tight fit section 22 is fitted into the shaft 5 by shrinkage-fitting or the like.

Herein, the length L1 of the tight fit section 22 in the axial direction, the thickness T1 of the tight fit section 22, and the internal radius R of the tight fit section 22 are set so as to satisfy the following expression (2).

[Expression 2]

$$L1/\sqrt{RT1} \geq 0.8\sim0.9 \quad (2)$$

From the viewpoint of material mechanics, it is possible to suppress the tight fit section 22 from widening outward in the radial direction due to the centrifugal force during rotation, by satisfying the expression (2). Thus, by satisfying the expression (2), the contact pressure of the tight fit section 22 can be maintained, and it is possible to suppress the deviation between the impeller 10 and the shaft 5.

A groove portion 18 is provided inside the rear side surface 12*b* of the disc 12 in the radial direction so as to surround the tight fit section 22. The groove portion 18 is formed by denting the rear side surface 12*b* of the disc 12 so as to follow the front side surface 12*a* on the entire periphery of the tight fit section 22 (hub 20). In this manner, by providing the groove portion 18, it is possible to remove the thick portion of the disc 12 so that the thickness of the tight fit section 22 becomes T1 in the axial range in which the tight fit section 22 is provided, and thereby reduce the thickness of the tight fit section 22. Furthermore, by providing the groove portion 18, the thickness difference of each portion of the disc 12 is reduced, and for example, when enhancing the strength of the disc 12 by quenching, annealing or the like, the heat treatment of the entire disc 12 can be evenly performed.

A loose fit section 24 is provided on the front side (the left side of FIG. 2) of the tight fit section 22. That is, the loose fit section 24 is provided on the front end side of the hub 20 compared to the tight fit section 22. An internal radius of the loose fit section 24 is set to be slightly greater than the internal radius R of the tight fit section 22. The internal radius of the loose fit section 24 is set to be slightly greater than the radius of the shaft 5. Thus, there is a clearance between an inner circumferential surface 24*a* of the loose fit section 24 and an outer circumferential surface 5*a* of the shaft 5. In addition, the internal radius of the loose fit section 24 may be set to be smaller than the radius of the shaft 5. In this case, the loose fit section 24 is fitted into the shaft 5 by a smaller tightening allowance than the tight fit section 22.

A plurality of blades 14 are provided on the front side surface 12*a* of the disc 12. For example, these blades 14 are plate-like members made of precipitation hardening stainless steel, like a disc. Each of the blades 14 has a constant plate thickness (blade thickness). The plurality of blades 14 are arranged in the circumferential direction of the disc 12 at predetermined intervals, and are provided approximately radially when viewed from the axial direction. Furthermore, each of the blades 14 stands up so as to be approximately perpendicular to the front side surface 12*a* of the disc 12.

For example, the blades 14 are joined to the front side surface 12*a* of the disc 12 by fillet welding or the like.

The cover 16 is provided on the front sides of the blades 14. As illustrated in FIG. 2, the cover 16 is a substantially circular plate-like member when viewed in a planar view. Furthermore, the cover 16 is curved and formed so as to follow the shape of the blade 14 in a side view when viewed from the cross section in the radial direction, and the front side surface 12*a* of the disc 12. The cover 16 is fixed to the front side front end of each blade 14, for example, by fillet welding or the like to suppress the vibration of each blade 14.

Effect of First Embodiment

In the present embodiment, the blades 14 are provided on the front side surface 12*a* (surface) of the disc 12, and a part of the hub 20 fitted into the shaft 5 is provided so as to protrude to the rear side with respect to the rear side surface 12*b* (rear surface) of the disc 12. For this reason, when the blades 14 are mounted on the front side surface 12*a* of the disc 12, the hub 20 is not obstructive. Thus, it is possible to provide the rotary machine 1 having satisfactory workability during manufacturing.

Furthermore, in PTL 1, since the sleeve portion fitted into the shaft is placed so as to be separated from the disc on which the center of the half section of the impeller is placed, there is a structure in which the sleeve portion easily widened outward in the radial direction. However, according to the present invention, the hub 20 is formed so that a part thereof projects from the rear side surface 12*b* of the disc 12, and the tight fit section 22 having the great tightening allowance is provided from the rear side to the front side. That is, since the hub 20 is provided near the center of the half section of the impeller 10, and the tight fit section 22 provided in the hub 20 is fixedly fitted into the shaft 5, it is possible to suppress the deviation between the impeller 10 and the shaft 5 at the time of rotation.

Furthermore, according to the present embodiment, by providing the tight fit section 22 over the front side with respect to the rear side surface 12*b* of the disc 12, the tight fit section 22 can be provided at a position closer to the center of the half section of the impeller 10. Thus, it is possible to suppress the deviation between the impeller 10 and the shaft 5 at the time of rotation.

Furthermore, according to the present embodiment, by providing the groove portion 18 in a region in which the disc 12 overlaps the range in which the tight fit section 22 are provided in the axial direction, that is, near the tight fit section 22, it is possible to suppress the tight fit section 22 from widening outward in the radial direction due to the centrifugal force at the time of rotation, and the contact pressure of the tight fit section 22 can be maintained. Thus, it is possible to reliably suppress the deviation between the impeller 10 and the shaft 5 at the time of rotation.

In addition, since the thick portion of the disc 12 can be removed by providing the groove portion 18, and the thickness difference of each portion of the disc 12 can be reduced, for example, when enhancing the strength of the disc 12 by quenching, annealing or the like, the heat treatment of the entire disc 12 can be evenly performed. Thus, it is possible to provide a rotary machine 1 having high performance and excellent strength.

(Rotary Machine of Second Embodiment)

Next, the rotary machine 1 of the second embodiment will be described.

Figure 4:
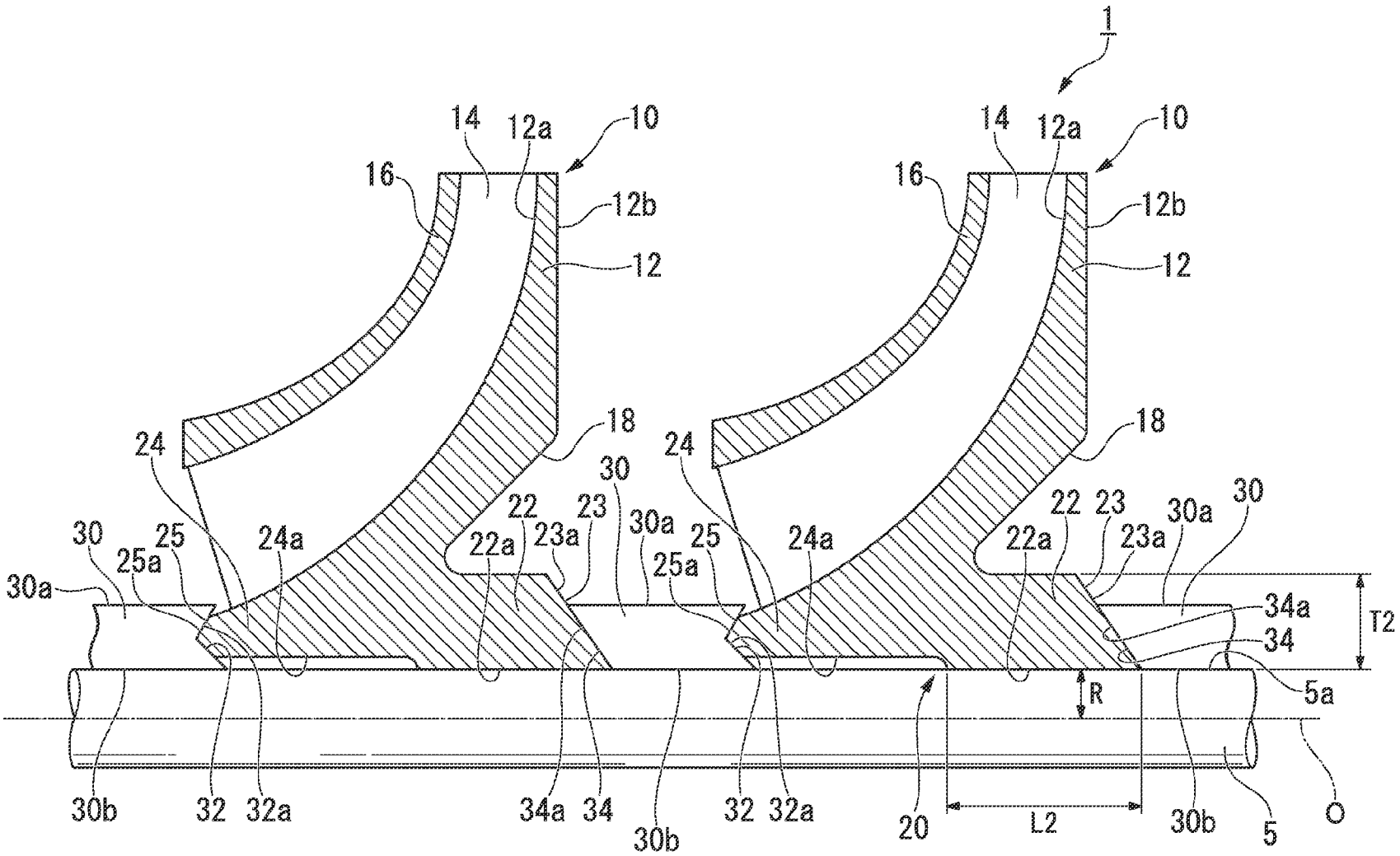
FIG. 4 is an explanatory view of a rotary machine of a second embodiment.

FIG. 4 is an explanatory view of the rotary machine 1 of the second embodiment.

In the first embodiment, in order to simplify the description, the rotary machine 1 in which one impeller 10 is provided in the shaft 5 is described. However, the second embodiment differs from the first embodiment in that a plurality (two in FIG. 4) of impellers 10 are provided in the shaft 5, shapes of the tight fit section 22 and the loose fit section 24 are different, and a sleeve 30 configured to distribute the gas G is provided.

Furthermore, for example, the rotary machine 1 of the second embodiment assumes a case in which the reduction in the length of the tight fit section 22 is required depending on the circumstances of the layout of the impeller 10 compared to the first embodiment. In addition, a detailed description of the same configuration portions as the first embodiment will be omitted here.

In the rotary machine 1 of the present embodiment, a plurality of impellers 10 is provided in series in the shaft 5. Moreover, the sleeve 30 is provided between the rear side surface 12*b* of the one disc 12 and the front side surface 12*a* of another disc adjacent to each other.

(Disc)

The tight fit section 22 has a thickness T2 in the radial direction, and is provided to have a length L2 from the rear side to the front side. Furthermore, a first tapered portion 23*a* is provided in the rear end 23 of the tight fit section 22. The first tapered portion 23*a* is formed in a substantially tapered shape in which the rear end thereof gradually widens from the rear side toward the front side (from the right side to the left side in FIG. 4).

Furthermore, in the rotary machine 1 of the second embodiment, for example, by the circumstances such as the layout, the tight fit section 22 is shortened compared to the first embodiment. That is, a relationship between the length L1 of the tight fit section 22 in the first embodiment and the length L2 of the tight fit section 22 in the second embodiment is L2<L1.

In addition, in the rotary machine 1 of the second embodiment, in order to supplement the reduction of the contact pressure of the tight fit section 22 when fitting the shaft 5 due to the reduction of the tight fit section 22, the thickness of the tight fit section 22 is increased compared to the first embodiment. That is, a relationship between the thickness T1 of the tight fit section 22 in the first embodiment and the thickness T2 of the tight fit section 22 in the second embodiment is T2>T1.

Herein, the length L2 of the tight fit section 22, the thickness T2 of the tight fit section 22, and the internal radius R of the tight fit section 22 are set so as to satisfy the following expression (3).

[Expression 3]

$$L2/\sqrt{RT2}<0.8\sim0.9 \quad (3)$$

Herein, there is a possibility of the thick portion of the tight fit section 22 being pulled outward in the radial direction due to the centrifugal force at the time of rotation, and the tight fit section 22 widening.

However, from the viewpoint of the material mechanics, it is possible to suppress the tight fit section 22 from widening due to the centrifugal force by satisfying the expression (3).

In the present embodiment, since the length L2 of the tight fit section 22, the thickness T2 of the tight fit section 22, and the internal radius of the tight fit section 22 are set so as to satisfy the expression (3), it is possible to suppress the tight fit section 22 from widening due to the centrifugal force. Thus it is possible to suppress the deviation between the impeller 10 and the shaft 5 at the time of rotation.

Furthermore, a convex portion 25*a* is provided in the front end 25 of the loose fit section 24. The convex portion 25*a* is formed in approximately a V shape having a top portion on the front side when viewed from the cross section in the radial direction. The convex portion 25*a* is fitted into a concave portion 32*a* provided in the sleeve 30 as will be described later. In addition, the shape of the convex portion 25*a* is not limited to the shape of the present embodiment, and may be, for example, an approximately rectangular shape when viewed from the cross-section in the radial direction.

(Sleeve)

A sleeve 30 is provided between one disc 12 and another disc 12 adjacent thereto. In addition, in the above-mentioned PTL 1, although the sleeve and the disc are integrally formed, the sleeve 30 of the present embodiment is provided as a separate component from the disc 12.

For example, the sleeve 30 is a member having an approximately cylindrical shape and being made of precipitation hardening stainless steel same as a disc. For example, the sleeve 30 is formed by cutting and then machining a seamless steel pipe. An internal diameter of the sleeve 30 is set to be slightly smaller than an external diameter of the shaft 5, and is fitted and fixed to the shaft 5 by shrinkage-fitting or the like. Furthermore, an external diameter of the sleeve 30 is set to be substantially the same as an external diameter of the loose fit section 24 of the disc 12.

The sleeve 30 is placed on the upstream side of the gas G (see FIG. 1) flowing in the impeller 10, that is, on the front side of the disc 12. The sleeve 30 distributes the gas G flowing in between the blades 14, and effectively guides the gas G.

A second tapered portion 34*a* is provided in the front end 34 of the sleeve 30. The second tapered portion 34*a* is formed in a shape corresponding to the first tapered portion 23*a* provided in the rear end 23 of the tight fit section 22. Specifically, the second tapered portion 34*a* is formed in an approximately tapered shape in which the front end thereof gradually widens from the rear side toward the front side (from the right to the left side in FIG. 4).

Furthermore, a concave portion 32*a* is provided in the rear end 32 of the sleeve 30. The concave portion 32*a* is formed in a shape corresponding to the convex portion 25*a* provided in the front end 25 of the loose fit section 24.

Specifically, the concave portion 32*a* is formed in approximately a V shape in which the front side thereof becomes a bottom when viewed from the cross section in the radial direction.

The sleeve 30 formed in this manner is placed between the rear side surface 12*b* of one disc 12 and the front side surface 12*a* of the other disc adjacent thereto. That is, the sleeve 30 is placed between the rear end of the hub 20 of one impeller 10 and the front end of the hub 20 of the other impeller 10 adjacent thereto.

At this time, the sleeve 30 is placed in a state in which the second tapered portion 34*a* of the sleeve 30 is brought into contact with the first tapered portion 23*a* of the disc 12. In addition, the sleeve 30 is placed in a state in which the convex portion 25*a* of the disc 12 is fitted into the concave portion 32*a* of the sleeve 30.

(Function)

When the rotary machine 1 is driven to rotate the impeller 10 mounted on the shaft 5, the hub 20 of the disc 12 is pulled outward in the radial direction due to the centrifugal force. For this reason, force attempting to widen outward in the radial direction works on the tight fit section 22 and the loose fit section 24.

However, the sleeve 30 is placed in the state in which the second tapered portion 34*a* and the first tapered portion 23*a* are brought into contact with each other. Thus, the second tapered portion 34*a* presses the first tapered portion 23*a* from the outside in the radial direction, restricts the movement of the tight fit section 22 due to the centrifugal force, and suppresses the tight fit section 22 from widening outward in the radial direction.

Furthermore, the sleeve 30 is placed in the state in which the concave portion 32*a* of the sleeve 30 and the convex portion 25*a* of the disc 12 are fit into each other. Thus, the concave portion 32*a* of the sleeve 30 restricts the movement of the loose fit section 24 due to the centrifugal force, and suppresses the loose fit section 24 from widening outward in the radial direction.

Effect of Second Embodiment

For example, in some cases, shortening of the length of the tight fit section 22 may be required depending on the circumstances such as the layout of the impeller 10. In this case, in order to supplement the reduction of the contact pressure due to shortening of the tight fit section 22, there is a need to increase the thickness of the tight fit section 22. However, when the thickness of the tight fit section 22 is increased, there is a risk of the thick portion being pulled outward in the radial direction due to the centrifugal force, the tight fit section 22 widening outward in the radial direction, and deviation between the impeller 10 and the shaft 5 being generated.

However, according to the present embodiment, by providing the first tapered portion 23*a* in the rear end 23 of the tight fit section 22 of the hub 20, it is possible to suppress the tight fit section 22 from widening outward in the radial direction due to the centrifugal force. Accordingly, by providing the first tapered portion 23*a*, it is possible to shorten the length of the tight fit section 22 and provide a small impeller 10, while reliably suppressing the deviation between the impeller 10 and the shaft 5 at the time of rotation.

Furthermore, according to the present embodiment, by placing the sleeve 30 on the front side of the disc 12 which is the upstream of the inflowing gas G, the gas G can be effectively guided. In addition, by individually providing the disc 12 and the sleeve 30, after joining the blades 14, the cover 16 or the like to the front side surface 12*a* of the disc 12 by welding or the like, the sleeve 30 can be placed on the front side of the disc 12. Accordingly, when the blades 14 or the like are joined to the front side surface 12*a* of the disc 12, the sleeve 30 is not obstructive. Thus, it is possible to provide the rotary machine 1 having the excellent workability at the time of manufacturing.

Furthermore, according to the present embodiment, since the second tapered portion 34*a* having the shape corresponding to the first tapered portion 23*a* is provided on the front end 34 of the sleeve 30, the sleeve 30 can be placed in the state in which the second tapered portion 34*a* is brought into contact with the first tapered portion 23*a*. Thereby, since the second tapered portion 34*a* is able to press the first tapered portion 23*a* from the outside in the radial direction, it is possible to suppress the tight fit section 22 from widening outward in the radial direction due to the centrifugal force. Thus, it is possible to reliably suppress the deviation between the impeller 10 and the shaft 5 at the time of rotation.

Furthermore, according to the present embodiment, the concave portion 32*a* is provided in the rear end 32 of the sleeve 30, and the convex portion 25*a* corresponding to the concave portion 32*a* is provided in the front end 25 of the loose fit section 24 of the hub 20. Thereby, since it is possible to fit the rear end 32 of the sleeve 30 and the loose fit section 24 by concavity and convexity, it is possible to restrict the movement of the loose fit section 24 by the sleeve 30, and it is possible to suppress the loose fit section 24 from widening outward in the radial direction due to the centrifugal force. Accordingly, it is possible to reliably suppress the deviation between the impeller 10 and the shaft 5 at the time of rotation.

(Rotary Machine of Third Embodiment)

Next, the rotary machine 1 of the third embodiment will be described.

Figure 5:
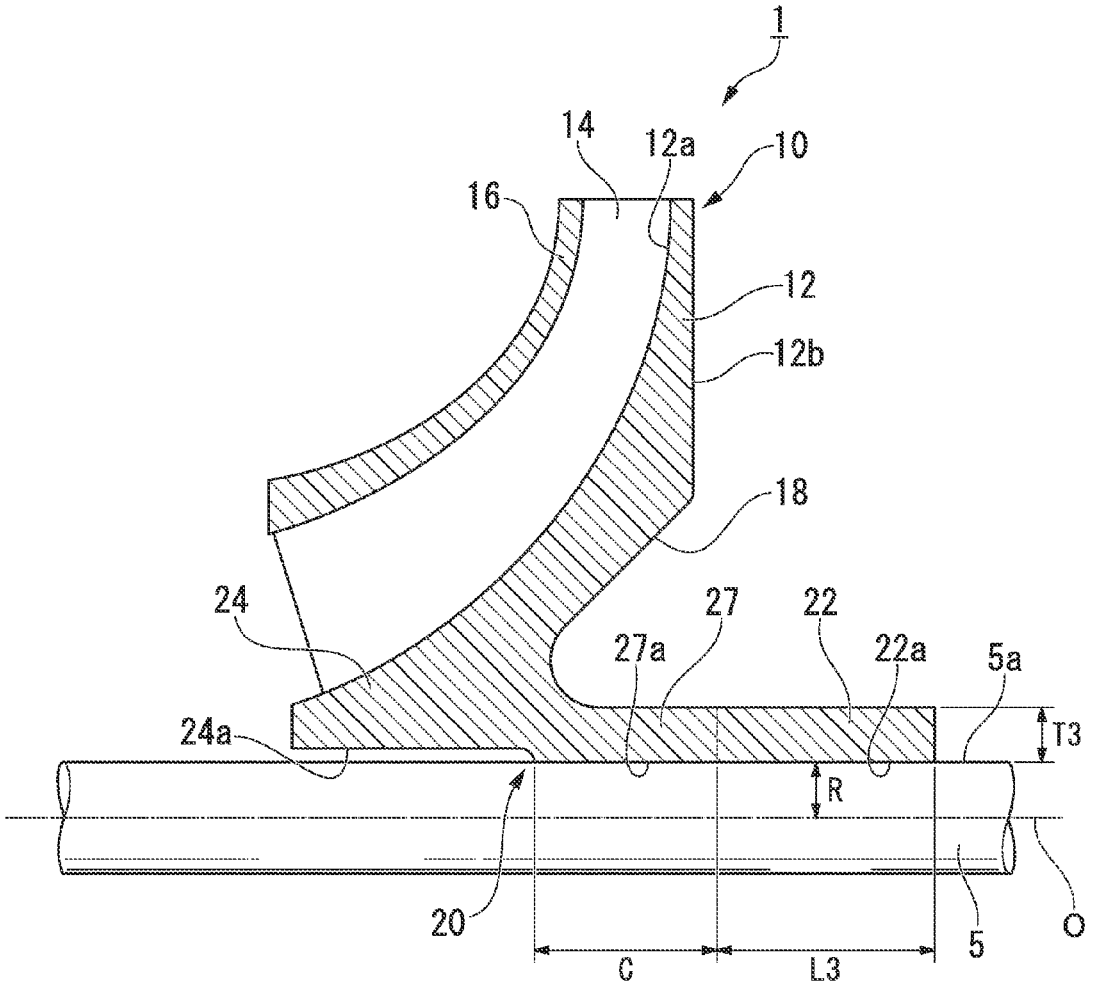
FIG. 5 is an explanatory view of a rotary machine of a third embodiment.
Figure 6:
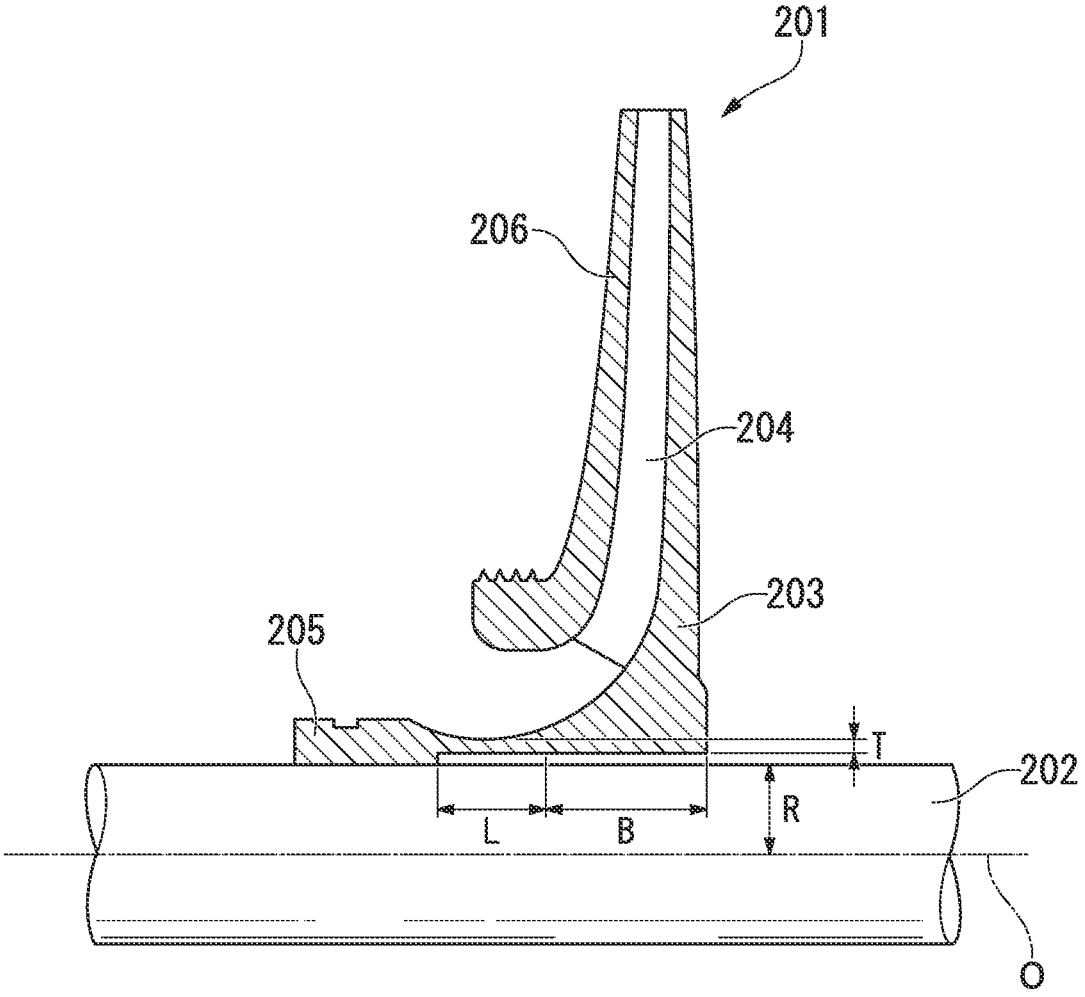
FIG. 6 is an explanatory view of a rotary machine of the related art.

FIG. 5 is an explanatory view of the rotary machine 1 of the third embodiment.

In the first embodiment and the second embodiment, the tight fit section 22 is provided over the front side with respect to the rear side surface 12*b* of the disc 12 from the rear side of the disc 12. However, the third embodiment differs from the first embodiment and the second embodiment in that the tight fit section 22 is provided in the range separated from the rear side surface 12*b* of the disc 12. In addition, a detailed description of the same configuration portions as those of the first embodiment and the second embodiment will be omitted here.

(Disc)

The hub 20 fitted into the shaft 5 is provided inside the disc 12 in the radial direction. A part of the hub 20 protrudes from the rear side surface 12*b* of the disc 12 and is a through hole that penetrates through the front side and the rear side of the disc 12. Furthermore, the hub 20 has the tight fit section 22 provided on the rear side, the loose fit section 24 provided on the front side, and an intermediate section 27 provided between the tight fit section 22 and the loose fit section 24.

The tight fit section 22 has a thickness T3 in the radial direction, and a length L3 from the rear side to the front side (in the axial direction).

Furthermore, the intermediate section 27 is provided between the tight fit section 22 and the loose fit section 24. The intermediate section 27 has the same thickness T3 as the tight fit section 22, and is provided on the front side of the tight fit section 22 by the length C.

The internal radius of the intermediate section 27 is set so as to be approximately equal to the internal radius of the tight fit section 22 or smaller than the radius of the shaft 15, and slightly greater than the internal radius of the tight fit section 22. That is, the tightening allowance of the intermediate section 27 when fitted into the shaft 5 is set so as to be approximately equal to the tightening allowance of the tight fit section 22, or slightly smaller than the tightening allowance of the tight fit section 22.

Herein, the length L3 of the tight fit section 22, the thickness T3 of the tight fit section 22, and the internal radius R of the tight fit section 22 are set so as to satisfy the following expression (4).

In addition, the length C of the intermediate section 27, the thickness T3 of the intermediate section 27, and an internal radius R of the intermediate section 27 are set so as to satisfy the following expression (5).

[Expression 4]

$$L3/\sqrt{RT3} \geq 0.8\sim0.9 \quad (4)$$

From the viewpoint of the material mechanics, by satisfying the expression (4), it is possible to suppress the tight fit section 22 from widening outward in the radial direction due to the centrifugal force at the time of rotation, and the contact pressure of the tight fit section 22 can be maintained. Thus, it is possible to reliably suppress the deviation between the impeller 10 and the shaft 5 at the time of rotation.

[Expression 5]

$$C/\sqrt{RT3} \geq 0.8\sim0.9 \quad (5)$$

From the viewpoint of the material mechanics, by satisfying the expression (5), even when force widening outward in the radial direction works due to the centrifugal force of the disc 12 at the time of rotation, the intermediate section 27 bends. Thus, the transmission of the influence due to the centrifugal force to the tight fit section 22 is suppressed, and widening of the tight fit section 22 to the outside in the radial direction is suppressed.

Effect of Third Embodiment

According to the present embodiment, by providing the intermediate section 27 in the length C between the tight fit section 22 and the loose fit section 24, the tight fit section 22 is fitted into the shaft 5 in the range separated from the rear side surface 12*b* of the disc 12. Thereby, the intermediate section 27 bends, and the influence due to the centrifugal force of the disc 12 can be relaxed. Thus, since it is possible to suppress the tight fit section 22 from widening outward in the radial direction due to the centrifugal force, it is possible to suppress the deviation between the impeller 10 and the shaft 5 at the time of rotation.

In addition, the present invention is not limited to the above-mentioned embodiments.

In each embodiment, a case in which the rotary machine 1 is applied to the centrifugal compressor 100 is described as an example.

However, the present invention is not limited thereto, and for example, the rotary machine 1 of the present invention can also be applied to a diagonal flow type compressor.

Furthermore, the rotary machine 1 of the present invention can also be applied to, for example, a blower, without being limited to the compressor.

Furthermore, in the rotary machine 1 of each embodiment, the present invention is applied to a closed impeller in which the cover 16 is provided on the front side of the blade 14. However, the present invention is not limited thereto, and the present invention can also be applied to an open impeller in which the cover 16 is not provided on the front side of the blade 14.

Furthermore, in the rotary machine 1 of each embodiment, a part of the hub 20 is formed so as to protrude from the rear side surface 12*b* of the disc 12. However, the lengths L1, L2 and L3 by which the hub 20 is provided are design items that are suitably set by the radius R of the shaft 5, and the thicknesses T1 and T2 of the tight fit section 22. Thus, the hub 20 may not protrude from the rear side surface 12*b* of the disc 12.

Furthermore, in the rotary machine 1 of each embodiment, the disc 12 is fitted into the shaft 5 by shrinkage-fitting. Furthermore, in the rotary machine 1 of the second embodiment, the sleeve 30 is fitted into the shaft 5 by shrinkage-fitting. However, the fitting method of the disc 12 and the sleeve 30 with respect to the shaft 5 is not limited to shrinkage-fitting, and, for example, the disc 12 may be fitted into the shaft 5 by pressure-fitting.

Furthermore, in the rotary machine 1 of the second embodiment, the convex portion 25*a* is provided on the front end 25 of the loose fit section 24, the concave portion 32*a* is provided on the rear end 32 of the sleeve 30, and the loose fit section 24 and the sleeve 30 are fitted into each other by concavity and convexity. However, the concave portion may be provided on the front end 25 of the loose fit section 24, the convex portion may be provided on the rear end 32 of the sleeve 30, and the loose fit section 24 and the sleeve 30 may be fitted into each other by concavity and convexity.

Furthermore, in the rotary machine 1 of the second embodiment, by fitting the loose fit section 24 and the sleeve 30 to each other by concavity and convexity, the movement of the loose fit section 24 due to the centrifugal force during rotation is restricted. However, for example, the third tapered portion having the internal radius gradually reducing toward the front end of the sleeve may be provided on the rear end 32 of the sleeve, and the fourth tapered portion having the external radius gradually reducing toward the front end of the hub 20 may be provided on the front end 25 of the loose fit section 24 of the hub 20 so as to be matched with the shape of the third tapered portion.

By placing the sleeve 30 so as to bring the third tapered portion and the fourth tapered portion into contact with each other, the loose fit section 24 can be pressed from the outside in the radial direction. Thus, like the second embodiment, the movement of the loose fit section 24 can be restricted, and it is possible to suppress the loose fit section 24 from widening outward in the radial direction due to the centrifugal force at the time of rotation.

INDUSTRIAL APPLICABILITY

According to the rotary machine of the present invention, when mounting the blades on the surface of the disc, the hub is not obstructive, and the workability during manufacturing is satisfactory.

Furthermore, according to the rotary machine of the present invention, the tight fit section provided in the hub of the impeller is fixedly fitted into the shaft, it is possible to prevent the tight fit section from widening due to the centrifugal force at the time of rotation, and it is possible to reliably suppress the deviation between the impeller and the shaft.

REFERENCE SIGNS LIST

1 rotary machine
5 shaft
5*a* outer circumferential surface (circumferential surface)
10 impeller
12 disc
12*a* front side surface (one side surface, surface)
12*b* rear side surface (the other side surface, rear surface)
14 blade
18 groove portion
20 hub
22 tight fit section
23*a* first tapered portion
24 loose fit section
25*a* convex portion
27 intermediate section
30 sleeve
32*a* concave portion
34*a* second tapered portion

The invention claimed is:

1. A rotary machine comprising:

a shaft that rotates;

a disc that has a substantially cylindrical hub fitted into the shaft and is provided so as to widen outward in a radial direction from a front end to a rear end of the substantially cylindrical hub; and an impeller having a plurality of blades provided on a surface of the disc, wherein the substantially cylindrical hub comprises:

a tight fit section having an internal radius that is smaller than a radius of the shaft; and a loose fit section having an internal radius that is greater than the internal radius of the tight fit section, wherein the loose fit section is provided on a front end side of the substantially cylindrical hub with respect to the tight fit section, and wherein a tapered portion having an external radius gradually increasing toward the front end of the substantially cylindrical hub is provided in the rear end of the substantially cylindrical hub.

2. The rotary machine according to claim 1, wherein a groove portion dented so as to surround the substantially cylindrical hub is provided on a rear surface of the surface of the disc.

3. The rotary machine according to claim 1, further comprising:

a sleeve that is fitted into the shaft so as to come into contact with the front end of the substantially cylindrical hub, and guides air flow to the disc.

4. The rotary machine according to claim 3, wherein the impeller is one of a plurality of impellers provided in series in the shaft, wherein a sleeve that guides the air flow to the disc of another one of the plurality of impellers is further included between the substantially cylindrical hub of the one of the plurality of impellers and the substantially cylindrical hub of the other one of the plurality of impellers, which are adjacent to each other, wherein the tapered portion is a first tapered portion, and wherein a second tapered portion having an internal radius gradually decreasing toward a rear end of the sleeve so as to be matched with a shape of the first tapered portion provided in the rear end of the substantially cylindrical hub is provided in a front end of the sleeve.

5. The rotary machine according to claim 3, wherein a concave portion is provided in one of a rear end of the sleeve and the front end of the substantially cylindrical hub, and a convex portion matched with a shape of the concave portion is provided in another one of the rear end of the sleeve and the front end of the substantially cylindrical hub.

6. The rotary machine according to claim 3, wherein a third tapered portion having an internal radius gradually decreasing toward a front end of the sleeve is provided in a rear end of the sleeve, and wherein a fourth tapered portion having an external radius gradually reducing toward the front end of the substantially cylindrical hub so as to be matched with a shape of the third tapered portion is provided in the front end of the substantially cylindrical hub.

7. The rotary machine according to claim 1, wherein the tight fit section is provided over the front end side of the substantially cylindrical hub with respect to a rear surface of the disc from the rear end of the substantially cylindrical hub.

8. The rotary machine according to claim 1, wherein the substantially cylindrical hub further comprises an intermediate section that connects the tight fit section with the loose fit section and a tightening allowance of the intermediate section is approximately equal to a tightening allowance of the tight fit section, or slightly smaller than the tightening allowance of the tight fit section.

* * * * *